United States Patent [19]

Mitsuhashi

[11] 3,951,325

[45] Apr. 20, 1976

[54] STAPLER WITH A PUNCH MECHANISM

[76] Inventor: Yoshio Mitsuhashi, 79, Higashi-Kibogaoka, Asahi, Yokohama, Kanagawa, Japan

[22] Filed: Apr. 23, 1975

[21] Appl. No.: 570,795

Related U.S. Application Data

[62] Division of Ser. No. 444,986, Feb. 22, 1974, Pat. No. 3,907,190.

[30] Foreign Application Priority Data

Feb. 26, 1973 Japan ..... 48-22954

[52] U.S. Cl. ..... 227/76

[51] Int. Cl.[2] ..... B25C 5/02

[58] Field of Search ..... 227/76, 128

[56] References Cited

UNITED STATES PATENTS

| | | | |
|---|---|---|---|
| 1,840,586 | 1/1932 | Jones | 227/76 |
| 2,489,050 | 11/1949 | Ruskin | 227/128 |
| 3,593,904 | 7/1971 | Gaya | 227/128 |

FOREIGN PATENTS OR APPLICATIONS

| | | | |
|---|---|---|---|
| 631,930 | 11/1949 | United Kingdom | 227/76 |
| 821,189 | 11/1951 | Germany | 227/76 |

*Primary Examiner*—Granville Y. Custer, Jr.
*Attorney, Agent, or Firm*—Haseltine, Lake & Waters

[57] ABSTRACT

A hand-operated stapler of the type comprising a base having an anvil die adjacent its front end, an open-top staple magazine pivotally coupled at its rear end to the base, and a lever also pivotally coupled to the base to depress the staple magazine onto the anvil die of the base whereby the foremost one of the staples within the magazine is dispensed therefrom to penetrate sheets of paper or the like and is further clinched by the anvil die to hold the sheets together. The stapler is characterized in that the staples within the staple magazine are urged forwardly by a feed element slidably mounted therein and a helical tension spring extending between the front end of the feed element and the front end of the lever, in such a manner that the spring is substantially folded over the rear end of the feed element.

3 Claims, 8 Drawing Figures

STAPLER WITH A PUNCH MECHANISM

CROSS RELATED APPLICATION

This Application is a division of copending Application Ser. No. 444,986 filed Feb. 22, 1974, and now U.S. Pat. No. 3,907,190, issued Sept. 23, 1975.

BACKGROUND OF THE INVENTION

This invention relates to improvements in a stapler of hand-operated class which is equipped with a punching mechanism to perform the dual function of stapling and punching.

The prior art staplers of the type described have been subject to the objection that only a limited number of staples can be accommodated within the staple magazine. This is due to the fact that the feed element slidably mounted within the staple magazine to urge the staples forward with the aid of a helical tension spring in accordance with the prior art must have a length greater than that of the spring when contracted to the minimum because, otherwise, the feed element cannot be urged toward the front end of the staple magazine to the last one of the staples. Although some devices have been developed to overcome this difficulty, they are either unnecessarily complex and expensive in construction or bulky in size.

The known dual-purpose devices capable of performing both stapling and punching functions also have a disadvantage in that the punching mechanism incorporated in such devices is susceptible to malfunctions and is so complex in construction that the manufacturing costs of the overall machines are increased to an extent that can be considered unnecessary in view of the teachings of this invention.

SUMMARY OF THE INVENTION

It is therefore an object of this invention to provide a hand-operated stapler of extremely simple and inexpensive construction, such that its staple magazine is capable of accommodating approximately twice as many staples as has been possible by prior art staplers of like size.

Another object of the invention is to provide a stapler of the class described, which incorporates a punching mechanism such that holes can be punched cleanly through sheets of paper or like penetrable material by the simple depression of the staple housing.

According to the novel concepts of this invention, the staples accommodated within the staple magazine are urged toward its front end by a feed element slidably mounted therein and a tension spring extending between the front end of the feed element and the front end of a lever pivotally coupled to a base in superposed relationship to the staple magazine. The tension spring is thus substantially folded as it extends over the rear end of the feed element, so that the length of this feed element can be reduced to a minimum. As an added advantage resulting from this feature of the invention, unused staples can be loaded into the staple magazine simply by turning the lever about 180 degrees away from the staple magazine because, then, the feed element is pulled back to its retracted position by the tension spring.

The punching mechanism incorporated in the stapler according to the invention comprises a punching die formed on the base between the two ends thereof, and perforating punch extending downwardly from the bottom of the staple magazine to be received in a bore formed through the punching die. Since the staple magazine is pivotally coupled to the base by a pin which is located in a plane where the bottom surface of the staple magazine comes into contact with the surface of the punching die, the perforating punch travels substantially perpendicularly to the surface of the die as it enters the bore formed therethrough, so that paper or the like held over the die can be punched in a cleanly cut manner.

The features which are believed to be novel and characteristic of this invention are set forth with particularity in the appended claims. The invention itself, however, both as to its construction and mode of operation, together with further objects and advantages thereof, will be best understood from the following description of a preferred embodiment taken in connection with the accompanying drawings, in which like reference numerals denote like parts throughout the several views.

DETAILED DESCRIPTION

Figure 1:
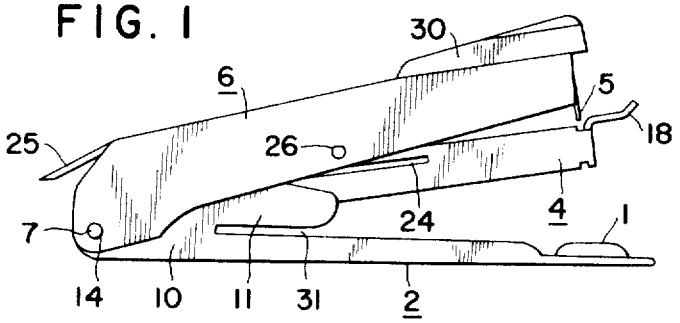
FIG. 1 is a side elevational view of a stapler constituting a preferred embodiment of the invention.
Figure 2:
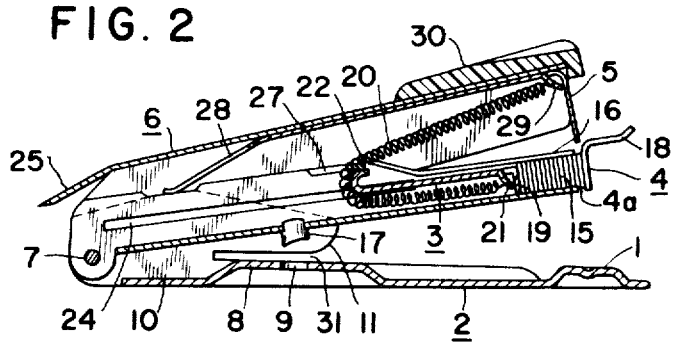
FIG. 2 is a vertical sectional view of the stapler of FIG. 1.

With particular reference to FIGS. 1 and 2, the stapler illustrated therein by way of a preferred embodiment of this invention includes an elongated, substantially flat base 2 having an elevated anvil die 1 adjacent its distal or front end which is adapted to clinch each staple pierced through paper or the like. A lever 6 having a staple ejector 5 extending downward from its distal or front end is turnably pivoted by a pin 7 on the base 2 at its proximal or rear end, and between the base 2 and the lever 6 an open-top staple magazine 4 having a feed element 3 slidably mounted therein is also pivoted on the base 2 by the pin 7 so as to be turnable up and down independently of the lever 6.

Figure 3:
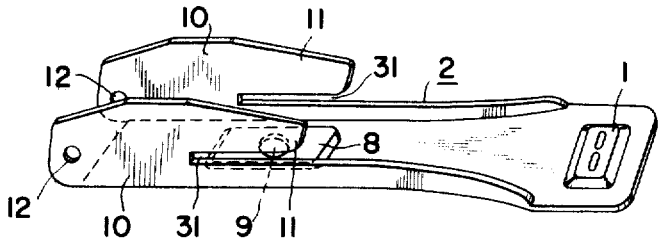
FIG. 3 is a perspective view of a base of the stapler of FIG. 1.

FIG. 3 best illustrates the detailed configuration of the base 2. In addition to the aforementioned anvil die 1 adapted to clinch each staple piercing paper or the like, the base 2 has another elevated punching die 8 formed between the two ends thereof as a part of a punching mechanism according to the invention, and a bore 9 is formed substantially centrally through the die 8 to receive a perforating punch 17, therethrough during a punching operation. A pair of upstanding side walls 10 are integrally formed with the base 2, and these side walls include forward extensions 11 defining slots 31 adapted to receive therein paper or the like to be perforated. Aligned holes 12 formed through respective side walls 10 are adapted to receive the pin 7 which also extends through holes 13 of the staple magazine 4 and holes 14 of the lever 6.

Figure 4:
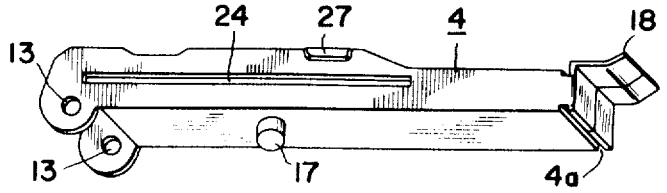
FIG. 4 is a perspective view of a staple magazine of the stapler of FIG. 1.

As best illustrated in FIG. 4, the staple magazine 4 has the aforesaid perforating punch 17 extending downwardly from its bottom at a point between the two ends thereof. A thumbpiece 18 extends forwardly from the front end of the staple magazine 4 for use in depressing the staple magazine and hence the perforating punch 17 down through the bore 9 of the die 8 for a punching operation. As indicated in FIG. 2, the staple magazine 4 may have the upper edges of the forward portions of its side walls bent toward each other as shown at 16 to prevent staples 15 accommodated therein from jumping out.

Figure 5:
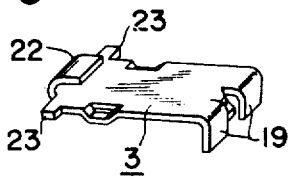
FIG. 5 is a perspective view of a feed element in the stapler of FIG. 1.

FIG. 5 illustrates in detail the configuration of the feed element 3 slidably mounted in the staple magazine 4. The front end of the feed element 3 is bent downwardly as indicated at 19 to make neat contact with the rearmost one of the staples 15 within the staple magazine 4, as will be seen from FIG. 2. A pair of lateral projection are formed at 23 to be slidably received in guide slots 24, as shown in FIG. 4, that are formed longitudinally through the side walls of the staple magazine 4, in such a manner that the feed element 3 is slidable back and forth within the staple magazine. Furthermore, a hook 21 is formed at or adjacent the front end of the feed element 3 for engaging one end of a helical tension spring 20 best illustrated in FIG. 2, and the rear end of the feed element 3 is shaped into a curved edge 22 over which the spring 20 is bent and substantially doubled, also as best seen in FIG. 2.

Referring back to FIGS. 1 and 2, the lever 6 may be equipped with a staple remover edge 25 extending backwardly therefrom and with a thumbpiece 30 on its front end. The side walls of the lever 6 have inward projections 26 formed in a transversely aligned manner at a point between the two ends thereof for releasable engagement with lateral expansions 27 formed correspondingly on the side walls of the staple housing 4.

A leaf spring 28, which may conveniently be formed in one piece with the staple ejector 5 and secured to the lever 6, extends obliquely downwardly from the lever 6 and resiliently engages at its bifurcated end 28a with the upper edges of the staple magazine 4 as well as the upper edges of the side walls 10 of the base 2 in the position of FIG. 2. A hook 29 is integrally formed at the front end of the leaf spring 28 to engage one end of the helical tension spring 20, the other end of which is engaged, as aforesaid, with the hook 21 of the feed element 3. The spring 20 is thus substantially folded as it extends over the curved rear end 22 of the feed element 3, thereby urging the feed element forwardly or rightwardly as viewed in FIG. 2 to cause the same to feed the staples 15 toward the front end of the staple magazine 4. The staple magazine 4, the lever 6 and the base 2 are normally maintained in the relative positions illustrated in FIGS. 1 and 2.

Figure 6:
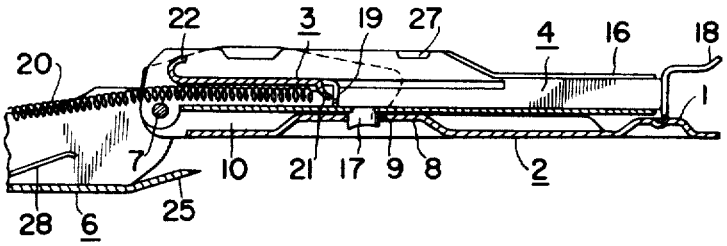
FIG. 6 is a fragmentary, vertical sectional view showing the stapler of FIG. 1 with its lever in a fully open position.

The preferred embodiment of the invention being constructed as hereinabove described, staples can be loaded into the staple magazine 4 through the open top thereof simply by first turning the lever 6 approximately 180 degrees away from the staple magazine and the base 2 as illustrated in FIG. 6, because then the feed element 3 within the staple magazine is caused to retract to the rearmost position by the tension of the helical tension spring 20. As the lever 6 is succeedingly returned to the position shown in FIGS. 1 and 2, the stapler is ready for operation. The releasable engagement of projections 26 with expansions 27 enables the turning of the lever 6 to the position in FIG. 6 and the subsequent reengagement of lever 6 with the magazine 4.

Figure 7:
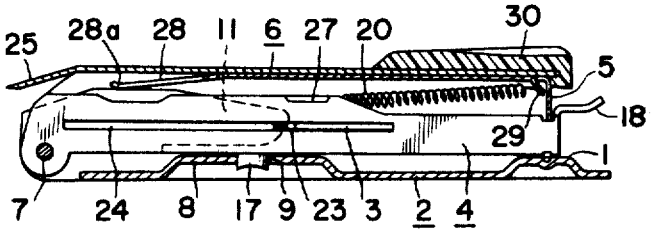
FIG. 7 is a vertical sectional view for a description of the stapling operation performed by the stapler of FIG. 1, the staple housing being illustrated in side elevation for the sake of simplicity.

For the stapling of paper or the like, the lever 6 is depressed in the usual manner onto the base 1 as illustrated in FIG. 7, with the result that the foremost one of the staples 15 within the staple magazine 4 is driven by the staple ejector 5 out of a dispensing aperture 4a formed through the bottom of the staple magazine at its front end. The staple thus ejected from within the staple magazine 4 pierces the layers of paper or the like held between the base 2 and the staple magazine 4 and is clinched as it strikes against the depressions formed in the anvil die 1 in accordance with the prior art. As the lever 6 is released after the stapling operation, this lever and the staple magazine are caused to return automatically to their respective positions of FIGS. 1 and 2 by virtue of the force of the leaf spring 28.

Figure 8:
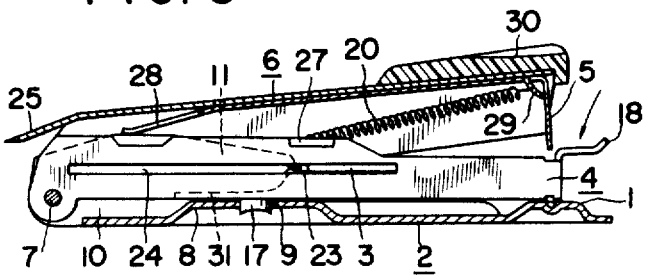
FIG. 8 is a view similar to FIG. 7 for a description of the punching operation performed by the stapler of FIG. 1.

A mode of use of the punching mechanism incorporated in the stapler according to the invention is illustrated in FIG. 8. Paper or the like to be perforated is inserted into the slots 31 formed in the side walls 10 of the base 2, and in this case the staple magazine 4 is depressed onto the base 2 by application of downward force to the thumbpiece 18. The perforating punch 17 is thus driven through the paper or the like and is properly received in the bore 9 formed through the elevated punching die 8 of the base 2. As the staple magazine 4 is released, the perforating punch 17 is moved upwardly out of the bore 9 by the force of the leaf spring 28 bearing on the upper edges of the side walls 10 of base 2 causing the magazine 4 to be carried by the lever 6 due to engagement of the projections 26 and the expansions 27, whereas the perforated paper or the like is left on the base 2 because it is retained in the slots 31 of the side walls 10.

It is particularly noteworthy that, as best seen in FIG. 8, the pin 7 pivotally interconnecting the base 2 and the staple magazine 4 has its axis located exactly in a plane where the top surface of the punching die 8 of the base and the bottom surface of the magazine contact each other. Thanks to this novel feature of the invention, the perforating punch 17 is caused to pass through the bore 9 substantially perpendicularly to the face of the punching die 8 when the staple magazine 4 is depressed onto the base 2 for punching operation or in other words when the punching cut is being effected, so that the paper or the like held on the punching die 8 can always be perforated in a cleanly cut manner.

What is claimed is:

1. In a stapler of the type including a base having an anvil die adjacent one end thereof, an open-top staple magazine having a staple dispensing aperture provided at distal end in a bottom wall thereof, said magazine being pivoted at its proximal end to the other end of said base so as to be turnable up and down relative thereto, a lever having a staple ejector at its distal end and also pivotally connected at its proximal end to the other end of said base so as to be turnable up and down relative thereto, said lever being adapted to drive each foremost staple accommodated within said staple magazine out of said dispensing aperture by said staple ejector such that the dispensed staple is clinched by said anvil die to hold layers of penetrable material together, a feed element slidably mounted within said staple magazine behind the staples accommodated therein, and spring means urging said feed element toward said dispensing aperture to feed the staples toward the dispensing aperture:

an improvement comprising a punching die on said base intermediate the ends thereof and having a planar surface and a bore formed therein;

a perforating punch extending downwardly from the bottom of said staple magazine at a position to be received in said bore of said punching die when said staple magazine is depressed onto said base; and a pin pivotally coupling at least said staple magazine at its proximal end to said other end of said base so that said magazine can be pivoted independently of said lever, said pin having an axis located on a line of intersection between the plane of said surface of said punching die and the plane of said bottom surface of said staple magazine.

2. A stapler as claimed in claim 1, further comprising a thumbpiece at said distal end of said staple magazine, said thumbpiece being positioned for use in depressing only said staple magazine onto said base to punch without effecting a stapling operation a hole in a layer of penetrable material by said perforating punch.

3. A stapler as claimed in claim 1, wherein said base includes a pair of upstanding parallel side walls respectively provided with slots extending parallel to and on both sides of said surface of the punching die, said slots receiving and retaining therein sheet material to be punched.

* * * * *